US007041177B2

(12) United States Patent
Ruhr et al.

(10) Patent No.: US 7,041,177 B2
(45) Date of Patent: May 9, 2006

(54) HIGH TEMPERATURE RAPID SOIL REMOVAL METHOD

(75) Inventors: Richard O. Ruhr, Buffalo, MN (US); Nathan Daniel Peitersen, Richfield, MN (US); Gerald Kurt Wichmann, Maple Grove, MN (US); Joseph I. Kravitz, Champlin, MN (US)

(73) Assignee: Ecolab Inc., St. Paul, MN (US)

( * ) Notice: Subject to any disclaimer, the term of this patent is extended or adjusted under 35 U.S.C. 154(b) by 502 days.

(21) Appl. No.: 10/222,451

(22) Filed: Aug. 16, 2002

(65) Prior Publication Data

US 2004/0033919 A1 Feb. 19, 2004

(51) Int. Cl.
*C11D 17/00* (2006.01)
*C11D 3/10* (2006.01)

(52) U.S. Cl. ..... 134/19; 134/26; 134/29; 510/218

(58) Field of Classification Search ..... 510/218, 510/234, 237, 255, 381, 500, 393, 421, 426, 510/434; 134/2, 3, 4, 19, 26, 29, 40, 25.3
See application file for complete search history.

(56) References Cited

U.S. PATENT DOCUMENTS

| | | | | |
|---|---|---|---|---|
| 2,976,248 A | * | 3/1961 | Otrhalek | 510/219 |
| 3,929,678 A | | 12/1975 | Laughlin et al. | 252/526 |
| 4,081,395 A | * | 3/1978 | Talley | 510/219 |
| 4,148,762 A | | 4/1979 | Koch et al. | 252/544 |
| 4,154,706 A | | 5/1979 | Kenkare et al. | 252/247 |
| 4,228,044 A | | 10/1980 | Cambre | 252/547 |
| 4,235,734 A | | 11/1980 | Scherubel | 252/142 |
| 4,329,336 A | | 5/1982 | Su et al. | 422/70 |
| 4,587,030 A | | 5/1986 | Casey | 252/92 |
| 4,730,592 A | | 3/1988 | Uozumi et al. | 123/516 |
| 4,743,395 A | | 5/1988 | Leifheit | 252/106 |
| 4,751,015 A | | 6/1988 | Humphreys et al. | 252/99 |
| 4,818,426 A | | 4/1989 | Humphreys et al. | 252/99 |
| 5,064,561 A | * | 11/1991 | Rouillard | 510/234 |
| 5,264,046 A | * | 11/1993 | Winston et al. | 134/42 |
| 5,380,468 A | * | 1/1995 | Gober et al. | 510/254 |
| 5,525,256 A | | 6/1996 | Morris et al. | 252/108 |
| 5,712,241 A | | 1/1998 | Gorlin et al. | 510/426 |
| 5,904,735 A | | 5/1999 | Gutierrez et al. | 8/137 |
| 5,998,358 A | | 12/1999 | Herdt et al. | 210/506 |
| 6,136,362 A | | 10/2000 | Ashton | 426/521 |
| 6,218,349 B1 | | 4/2001 | Kravitz et al. | 510/218 |

FOREIGN PATENT DOCUMENTS

| | | |
|---|---|---|
| CA | 2004895 | 12/1989 |
| WO | 91/10719 | 7/1991 |

OTHER PUBLICATIONS

Kirk–Othmer, Encyclopedia Of Chemical Technology, Third Edition, vol. 5, pp. 339–366 and vol. 23, pp. 319–320.
Ullman's Encyclopedia of Industrial Chemistry, Milk and Dairy Products, Chapter 7.3.

* cited by examiner

*Primary Examiner*—Gregory Webb
(74) *Attorney, Agent, or Firm*—Vidas, Arrett & Steinkraus

(57) ABSTRACT

A method of removing soil an article including the steps of immersing said article in an alkaline composition having a concentration of at least one source of alkalinity about 0.25% or higher, dehydrating the soil and rehydrating the soil at a pH which is neutral. The method is particularly useful for removing proteinaceous soil from processing equipment for dairy products.

21 Claims, 18 Drawing Sheets

(18 of 18 Drawing Sheet(s) Filed in Color)

HTST soiled panels
3 hours at 76°C with recirculated whole milk

Example 1

HTST soiled panels
3 hours at 76°C with recirculated whole milk

Example 1

HTST soiled panels after 10 Minute Immersion in
1.5% NaOH and 0.6% Exxelerate 320

Example 1

Panels after 3 Minute Immersion in 38°C City Water

Oven Dry Times

10 Minutes @ 95°C

20 Minutes @ 95°C

Example 1

Panels after 6 Minute Immersion in 38°C City Water

Oven Dry Times

10 Minutes @ 95°C

20 Minutes @ 95°C

Example 1

Panels after 20 Minute Immersion in 38°C City Water

Oven Dry Times

10 Minutes @ 95°C

20 Minutes @ 95°C

Example 1

Panels Removed after 60 Minute Immersion in 38°C City Water

Example 1

HTST Soiled Panels
3.75 hours at 78°C with Recirculated Whole Milk

Example 2

HTST Soiled Panels after 15 Minute Immersion in
1.5% NaOH and 0.6% Stabilon ACP

Example 2

HTST Soiled Panels after 15 Minute Immersion in
1.5% NaOH and 0.6% Stabilon ACP then Dried for 15 min @ 95C Example 2

HTST Soiled Panels after 15 Minute Immersion in
1.5% NaOH and 0.6% Stabilon ACP, Dried for 15 Min @ 95C,
and Re-immersed in Their Respective Rinse Solutions Immersed in 1.0% AC-101
for 12 Minutes Immersed in Water
for 12 Minutes Example 2

Different Rehydration Solutions

HTST Soiled Panels after 15 Minute Immersion in
1.5% NaOH and 0.6% Stabilon ACP, Dried for 15 Min @ 95C,
and Re-immersed in Their Respective Rinse Solutions for 15 min Example 2

HTST soiled panels
3 hours at 77°C with recirculated whole milk

Example 3

Example 3

Example 3

Example 3

HTST Soiled Panel
3 hours at 80°C with Recirculated Whole Milk

Example 4

HTST Soiled Panel after 20 Minute Immersion in
3.1% AC-101 and 0.6% Stabilon ACP @ 150 F Example 4

HTST Soiled Panel Dried for 30 Min in Heat Exchanger Unit with Steam Followed by 20 Minute Rinse in Unit with 100°F Water Example 4

HIGH TEMPERATURE RAPID SOIL REMOVAL METHOD

FIELD OF THE INVENTION

The present invention relates to an improved method for removing soil from an article, particularly for the removal of proteinaceous soil from equipment used for processing of dairy product.

BACKGROUND OF THE INVENTION

Pasteurization of liquid foods has the goal of destroying all pathogenic microorganisms in milk, notably *Mycobacterium tuberculosis* and other pathogens such as *Brucella species, Salmonella* or *Escherichia coli* bacteria. While pasteurization does reduce the number of viable vegetative bacteria by several orders of magnitude, it does not reduce the content of viable spores. Pasteurization of liquid foods such as milk, fruit juice or soups requires that the liquid be raised to a sufficiently high temperature for a sufficient length of time so as to render the liquid safe for consumption for a specified period of time known as shelf life. Continuous pasteurization systems for milk must meet prescribed parameters set by governmental authorities for temperature and duration at that temperature. The United States Food and Drug Administration (FDA), for example, has developed the Pasteurized Milk Ordinance (PMO) which requires milk to be raised to a temperature of about 162° F. (approximately 74° C.) for a minimum of 16 seconds. In view of the low intensity of a pasteurizing heat treatment, the nutritional quality of pasteurized milks is virtually unimpaired. Milk is no longer considered legal if untreated milk is later mixed with the pasteurized milk, and is unacceptable for sale and consumption if intermixed with cleaning liquids.

The conditions required for pasteurization of various foodstuffs may vary. For dairy processing, probably the most widely used process today is referred to in the art as a continuous high-temperature short-time (HTST) procedure, where the milk is rapidly (within a few seconds) heated to temperatures of about 74° C. and held for 15 to 20 seconds at this temperature as required by FDA standards. U.S. Pat. No. 6,136,362 describes such an HTST process.

HTST pasteurization is performed with plate heat exchangers transferring the heat across the metal wall from the heating medium (hot water) to the product (milk) or, in the regeneration section, from the outflowing heated milk to the incoming, cool milk. Between the heating and the cooling section, a holding tube is inserted to provide the necessary holding time of the milk at the pasteurization temperature. The heated milk flows through the cooling section where it is cooled with ice water or brine.

These processes of course may be varied depending on the liquid food being pasteurized. For example, cream requires higher temperatures for effective destruction of harmful microorganisms.

Milk is supersaturated in calcium and phosphate by virtue of the ability of the casein micelle to keep micelle-linked calcium phosphate in a colloidal state. In the milk serum calcium is mainly chelated by citrate ions, and, to a lesser extent, by phosphate ions.

When milk is heated, the pH is lowered due to lactose degradation and the formation of organic acids, such as formic acid. Tricalcium phosphate is formed and some of it may be precipitated from the milk. Calcium phosphate deposits on heat exchangers and in evaporators (fouling) are frequently occurring in dairy plants and are formed during the processing of milk as well as of whey. The deposits usually are not purely mineral but also contain significant amounts of protein. This reaction is responsible for the formation of calcium phosphate deposits during storage of UHT milks.

Such protein soil residues occur in all types of food processing equipment, but are particularly common with milk and milk products which are high in proteins, and may be left on the surfaces of pasteurizing equipment. Furthermore, it is particularly important with milk and milk products to remove such soil because dairy products are among the most perishable of major foodstuffs and soil residues may have serious quality consequences.

Residual protein soil left on food contact equipment surfaces can harbor and nourish the growth of opportunistic pathogen and food spoilage microorganisms. These pathogen and microorganisms can contaminate foodstuffs processed in close proximity to the residual soil. Insuring protection of the consumer against potential health hazards associated with food borne pathogens and toxins requires diligent cleaning and soil removal from any surface that contacts the food product directly or any surface that is associated with the processing environment.

Because of food quality concerns and public health pressures, the food processing industry has attained a high standard of practical cleanliness and sanitation.

There remains a need in the industry, however, for more effective and safe compositions suitable for removing proteinaceous soils, and for more efficient and less costly methods of achieving the soil removal goals as set by industry and government standards.

SUMMARY OF THE INVENTION

The present invention relates to an improved method of removing soil from an article. More particularly, the present invention relates to a method of removing proteinaceous soil or carbohydrates from food or beverage processing equipment including that equipment used in the processing and handling of dairy products, malt beverages, and fruit juices. Thus, the method is particularly useful for removing milk soil from dairy processing equipment.

The method for the removal of soil from an article according to the present invention includes the steps of immersing the article in an alkaline composition having a concentration of at least one source of alkalinity about 0.25% or higher, dehydrating the soil, and rehydrating the soil with an aqueous composition at a pH which is about neutral.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTIONS OF THE PREFERRED EMBODIMENTS

Figure 1:
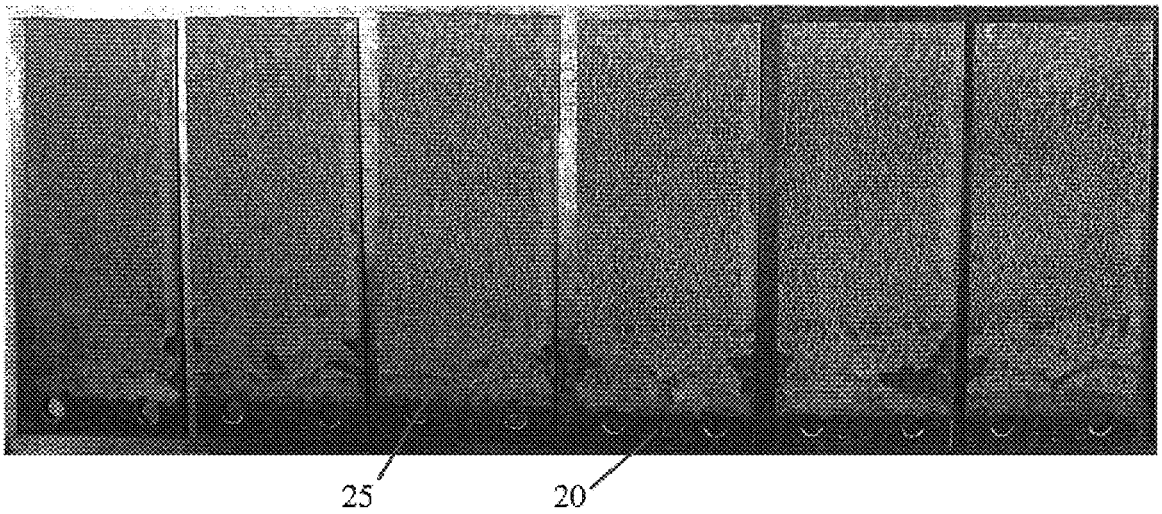
FIG. 1 shows a series of HTST soiled panels which have been exposed to recirculated whole milk.

While this invention may be embodied in many different forms, there are described in detail herein specific embodiments of the invention. This description is an exemplification of the principles of the invention and is not intended to limit the invention to the particular embodiments illustrated.

In general, the soil removal process of the present invention includes a soil removal step with an alkaline composition, a soil dehydrating step, and a soil rehydrating and swelling step, which may be referred to as imbibition, with an aqueous composition at a pH which is near neutral. The more acidic and basic compositions have been found to have a negative impact on the amount and/or rate of swelling.

The soil removal step is accomplished with an alkaline cleaning composition which includes at least a source of alkalinity at a concentration of about 0.25% of more, and more suitable about 1% or more. Suitably, the pH of the alkaline soil removal composition is about 10 or higher. Other additives may also be incorporated into the alkaline cleaning composition and will be discussed in detail below. Initial temperatures of the wash solution are desirably between about 70° C. and 85° C. (about 160° F. to about 180° F.) but not necessarily so.

Following the soil removal step is a dehydrating step which involves heating/drying of the post alkaline treatment soil. The rate and degree of swelling of the soil is affected by the amount of heating/drying which is done on the post alkaline treatment soil. Drying can be accomplished at room temperature, but more extended periods of time of time are required of as much as about 24 hours. Drying may be accomplished between about 15° C. and about 200° C. Higher temperatures of about 35° C. (about 95° F.) to about 200° C. (about 365° F.) can accomplish drying of the post alkaline wash soil much more quickly. For example, oven drying at a temperature of about 95° C. (about 200–205° F.) can accomplish dehydration in as little as about 10 to about 20 minutes. Steam heating in a sealed, high temperature short time simulation unit may even be accomplished in as little as about 5 to about 10 minutes. Thus, the length of time required to modify the post alkaline wash soil is inversely related to the temperature at which drying is accomplished.

Following dehydrating of the soil, is a rehydrating step wherein the rehydrating composition employed has a pH which is near neutral. Rehydration and swelling may also be referred to as "imbibition". More acidic or basic compositions may inhibit the rate of swelling. Suitably, the aqueous composition employed is desirably at ambient or room temperature or higher. Suitably, the temperature is about 20° C. to about 85° C.).

Both the alkaline cleaning composition, and the rehydrating composition, may include a variety of optional ingredients which will be described in detail below.

The Alkaline Source

The alkaline cleaning composition employed in the method of the present invention includes at least one source of alkalinity at a concentration of about 0.25% or more, and more suitably about 1% or more. Any alkaline source may be employed herein. However, some suitable examples of useful sources of alkalinity include, but are not limited to, the alkali metal hydroxides, alkaline earth metal hydroxides, amine including the alkylamines and ethanolamines, alkali metal carbonates or bicarbonates, silicates, and so forth, and mixtures thereof.

Particularly cost effective sources of alkalinity include, for example, sodium hydroxide, potassium hydroxide, magnesium hydroxide, calcium hydroxide, ammonium hydroxide, or mixtures thereof.

Surfactants

Surfactants may be incorporated both in the alkaline composition employed for removal of soil, and in the aqueous composition employed for rehydrating the soil. Surfactants can increase the amount of soil removed in the alkaline wash step, and also can assist in the removal of fatty soil deposits. Following the drying step, surfactants can increase the rate of swelling upon immersion in water.

Nonionic, anionic, cationic, zwitterionic and amphoteric surfactants find utility herein.

Examples of useful nonionic surfactants include, but are not limited to, surfactant selected from the group consisting of nonionic phosphate esters such as KLEARFAC® AA 270 available from BASF and RHODAFAC® RP 710 which is a phosphate ester phenol ethoxylate available from Rhodia and MERPOL® A which is a proprietary phosphate ester available from Stepan Co.; amine oxides such as a branched $C_{12}$ dimethylamine oxide available under the trade name of BARLOX® 12i, decyl dimethylamine oxide available under the trade name of BARLOX® 10S, octyl dimethylamine oxide available under the trade name of FMB AO8 and AO 14–2 iso $C_{10}$ bis-(2-hydroxyethyl) propylamine oxide available from Tomah Chemical Co; fatty alcohols such as TRITON® CF 10 which is a modified alkylaryl polyether (CP 25–35° C.) available from Union Carbide; alcohol alkoxylates such as $C_{10}$–$C_{20}$ alcohols ethoxylated with an average of from about 4 to about 10 moles of ethylene oxide per mole of alcohol including TERGITOL® 15-S-9 available from Union Carbide Corp. and ANTAROX® BL 330 which is a chlorine capped $C_{10-14}$ alcohol ethoxylate available from GAF, $C_9$–$C_{11}$ alcohol ethoxylate with about 4 moles ethylene oxide available from Akzo Nobel under the trade name of BEROL® 260, NEODOL® 45–9, 23–6.5, 45–7, 45–4, and so forth available from Shell Chemical Co., BEROL® 840 which is a 2-ethylhexanol ethoxylate available from Akzo Nobel, and so forth; aromatic alcohol ethoxylates such as LF-428 which is a benzyl capped alcohol ethoxylate available from Ecolab, Inc in St. Paul, Minn., alkylphenol alkoxylates such as nonylphenol ethoxylates and octylphenol ethoxylates such as TRITON® nonionic surfactants available from Union Carbide, alcohol ethoxylate-propoxylates such as the SYNPERONIC® series available from Uniqema (ICI) such as LF/RA 30 (CP 34° C.) and NCA 830 (CP 19° C.), and so forth; block copolymers of propylene oxide and ethylene oxide such as PLURONIC® AND PLURONIC® R surfactants available from BASF; tetrafunctional block copolymers derived from the addition of ethylene oxide and propylene oxide to ethylenediamine such as TETRONIC® and TETRONIC® R nonionic surfactants available from BASF; alkylpolysaccarides including polyglycosides; fatty acid amides; polyhydroxy fatty acid amides; N-alkoxy and N-aryloxy polyhydroxy fatty acid amide surfactants; alkyl aldonamides; alkyl aldobionamides; alkyl glycamides; alkanolamides such as the modified coco alkanolamides available under the trade name of NINOL® 1281 available from Stepan Chemical Co.;and so forth; and mixtures thereof.

Examples of useful anionic surfactants include, but are not limited to, alkyl ether sulfonates wherein the sulfonate provides some anionic character while the ethylene oxide chain provides some nonionic character; polycarboxylates such as $C_9$ polycarboxylated alcohol ethoxylate sold under the trade name of PLURAFAC® CS-1 available from BASF, MONA® NF 20 available from Uniqema (ICI) and TRITION® DF 20 available from Rohm & Haas; alkali metal soaps such as the alkali metal salts such as sodium and potassium, and organic base salts such as ammonium and alkylolammonium salts of higher fatty acids; alkali metal, ammonium and alkylolammonium salts of organic sulfuric reaction products such as alkyl sulfates, alkyl ether sulfates, alkyl aromatic sulfonates such as alkyl benzene sulfonates, alkyl polyalkoxylate sulfates such as alkyl polyethoxy sulfates, alkyl glyceryl ether sulfonates, alpha olefin sulfonates, sulfosuccinates, alkyl diphenylene oxide disulfonates such as those available under the tradename of DOWFAX® Hydrotropes available from Dow Chemical Co. in Midland, Mich. including hexadecyl diphenyloxide disulfonate disodium salt; phosphate surfactants such as the alkyl phosphates; N-alkyl substituted succinamates; and so forth; and mixtures thereof.

Examples of useful zwitterionic surfactants include, but are not limited to, derivatives of secondary and tertiary amines, derivatives of heterocyclic secondary and tertiary amines, or derivatives of quaternary ammonium, quaternary phosphonium or tertiary sulfonium compounds, and so forth.

Examples of useful amphoteric surfactants include, but are not limited to, the amphoteric amines such as those described in U.S. Pat. No. 3,939,678; betaines such as cocoamidopropyl betaine; phosphorous containing amphoterics such as phosphate esters including the proprietary PHOSPHOTERIC® TC-6 available from Uniqema (ICI); complex amine carboxylates such as cocoamphocarboxydipropionate available under the trade name of MONATERIC® CEM-3 8 available from Mona Industries (ICI) and Alkali Surfactant which is a dipropionate amphoteric available from Tomah Chemical Products in Milton, Wis.; amphoteric phosphate esters such as AMPHOTERIC TC which is an alkylimino acid, monosodium salt available from Exxon Chemical Corp.; and so forth; and mixtures thereof.

Examples of suitable nonionic, anionic, zwitterionic and amphoteric surfactants are described in U.S. Pat. No. 3,929,678 incorporated by reference herein in its entirety.

Examples of useful cationic surfactants include, but are not limited to, polyethoxylated fatty amine surfactants which are mildly cationic and tend to approach nonionic character with increasing degrees of ethoxylation; cationic quaternary ammonium surfactants; and so forth. Cationic surfactants are described in U.S. Pat. No. 4,228,044 incorporated by reference herein in its entirety.

Suitable surfactants of the types described above are also described in U.S. Pat. No. 5,904,735 incorporated by reference herein in its entirety.

Chelating/Seguestering Agents

The alkaline cleaning composition and the rehydrating compositions of the present invention may also optionally include a chelating/sequestering agent. Chelating/sequestering agents can provide water hardness control in the alkaline wash solution, and more importantly, can provide assistance in the soil removal process by interacting with various calcium and magnesium complexes of both organic and inorganic soil components. Water hardness ions can negatively interfere with the cleaning process by forming less soluble complexes with fatty acids or other surfactants. Chelating/sequestering agents provide water hardness control by interacting with water hardness ions such as calcium and magnesium hydroxides, carbonates, sulfates, chlorides, and other ions which are less soluble in alkaline solutions and which, upon exposure to heat as during the dehydrating step, may precipitate from solution. The chelating/sequestering agents thus help to keep the water hardness ions in solution.

Any chelating/sequestering agents known to those in the art may find utility herein. Examples of suitable chelating/sequestering agents include, but are not limited to, aminocarboxylic acids, condensed phosphates, phosphonates, polyacrylates, alkali metal gluconates, citrates, and so on and so forth.

In general, any chelating molecule which is capable of coordinating (i.e., binding) the metal ions commonly found in natural water to prevent the metal ions from interfering with the action of the other detersive ingredients of a cleaning composition may find utility herein. The chelating/sequestering agent may also function as a threshold agent when included in an effective amount. Preferably, a cleaning composition includes about 0.1–1 wt-%, preferably from about 0.05–5 wt-%, of a chelating/sequestering agent.

More particularly, suitable aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Suitable examples of condensed phosphates useful in the present composition include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

Suitable examples of phosphonates useful herein include, but are not limited to, aminotris(methylene phosphonic acid), hydroxyethylidene diphosphonic acid, ethylenediaminetetrae(methylene phosphonic acid), diethylenetriaminepente(methylene phosphonic acid), and the like. It is preferred to use a neutralized or alkaline phosphonate, or to combine the phosphonate with an alkali source prior to being added into the mixture such that there is little or no heat generated by a neutralization reaction when the phosphate is added.

Suitable examples of polyacrylates include, but are not limited to, polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like.

For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

Other optional ingredients may be included in both the alkaline wash composition and in the rehydrating composition. Such optional ingredients include, but are not limited to, other water hardness control agents, defoamers, solvents, oxidizing agents, reducing agents, bleaching agents, bleach activators, enzymes, urea and other additives which assist in breaking the symplexes which form between various soil components, and so forth, and any mixtures thereof.

Solvents

Solvents which may be optionally employed in both the alkaline soil removal composition and in the rehydration composition include, but are not limited to, glycol ethers, alcohols, esters such as soy methyl ester, acetates, cyclic acids, and so forth, and mixtures thereof.

Oxidizing Agents

Oxidizing agents which may be optionally employed in the compositions of the present invention include, but are not limited to, the alkali metal hypochlorites such as sodium and potassium hypochlorite, chlorine dioxide solutions, various peracids, and so forth, and mixtures thereof.

Reducing Agents

Reducing agents may be optionally employed in the compositions of the present invention and include, but are not limited to, the alkali metal thiosulfates such as sodium thiosulfate, the alkali metal sulfites such as sodium sulfite, the alkali metal metabisulfites such as sodium metabisulfite, and so forth, and mixtures thereof.

Bleaching Agents

Any suitable bleaching agents known in the art may be incorporated into the compositions. Some examples include compounds which release halogens (e.g. Cl, Br, OCl and/or OBr) under the conditions encountered during the cleansing process such as a chlorine, hypochlorite, chloramine, alkali metal dichloroisocyanurates, chlorinated trisodium phosphate, the alkali metal hypochlorides, monochloramine and dichloramine, and the like and the bromine releasing compounds as well.

Oxygen bleaching agents may also be employed including the peroxygen type or active oxygen source such as hydrogen peroxide, organic and inorganic peroxohydrates, organic peroxyacids including peroxycarboxylic, peroxyimidic and amidoperoxycarboxylic acids, or their salts including alkali metal or mixed-cation salts, perborates, sodium carbonate peroxyhydrate, phosphate peroxyhydrates, potassium permonosulfate, and sodium perborate mono and tetrahydrate, with and without activators such as tetraacetylethylene diamine, peracids which can be employed both as free standing and as bleach activators, inorganic peroxides, inorganic peroxoacids and their salts, certain organic peroxides, and the like, and mixtures thereof.

Bleach Activators

Any bleach activators known in the art may be employed including, for example, tetraacetyl ethylene diamine (TAED), sodium nonanoyloxybenzene sulphonate (SNOBS), glucose pentaacetate (GPA), tetra acetylmethylene diamine (TAMD), triacetyl cyanurate, sodium sulphonyl ethyl carbonic acid ester, sodium acetyloxybenzene and the mono long-chain acyl tetraacetyl glucoses as disclosed in WO 91/10719 incorporated by reference herein in its entirety, choline sulphophenyl carbonate (CSPC) can also be employed, as disclosed in U.S. Pat. Nos. 4,751,015 and 4,818,426 both of which are incorporated by reference herein in their entirety.

The above lists are not exhaustive and are intended for illustrative purposes only, and not as any limitation on the scope of the present invention, or on the claims attached hereto.

The present invention may be employed for any surface which has heat transfer food or beverage products that contain proteins and carbohydrates and which may be safely cleaned with alkaline compositions as well as drying and immersion in the aqueous based rehydrating composition.

High temperature/short time pasteurization equipment for which the present invention may be employed is described, for example, in U.S. Pat. No. 6,136,362 which is incorporated by reference herein in its entirety. The soil challenges in cleaning this type of equipment is also discussed in Ullmann's Encyclopedia of Industrial Chemistry, Milk and Dairy Products, Chapter 7.3 which is also incorporated by reference herein.

Examples of industries in which such equipment and surfaces may be found include the food, dairy and beverage industries, restaurants, and any institutional applications which involve food preparation.

The proteinaceous material may be located on any surface that comes into contact with dairy products, for instance. Examples of dairy equipment for which the present invention may be employed include, for example, cheese vats, fast-food milkshake machines, pasteurizers, whey evaporators, permeate evaporators, ultra-high temperature dairy processing equipment, mixing vessels used to make dairy-based products that require heating, and so forth. As such, the method and compositions of the present invention can effectively remove proteinaceous material from such equipment.

The method of the present invention finds utility for clean-in-place (CIP) cleaning systems within food process facilities, and, most particularly for dairy farm and fluid milk and milk by-product producers. The present invention is also suitably employed for any warewashing applications.

The surface having the proteinaceous material can be contacted with the soil removal composition in any suitable manner. Thus, the composition can be applied to the surface, for example, by brushing the surface with the composition, by spraying the surface with the composition, by wiping the surface with the composition, by soaking the surface with the composition, by CIP (clean-in-place circulation cleaning), or any combination thereof. The size and shape of the surface to be contacted can influence the manner in which the surface can be contacted. As such, it may be more effective to spray the surface of a cheese vat with the composition while it may be more effective to wipe, brush or soak the surface of a fast-food milkshake machine with the composition.

The following non-limiting examples further illustrate the present invention.

EXAMPLES

Example 1

Figure 2:
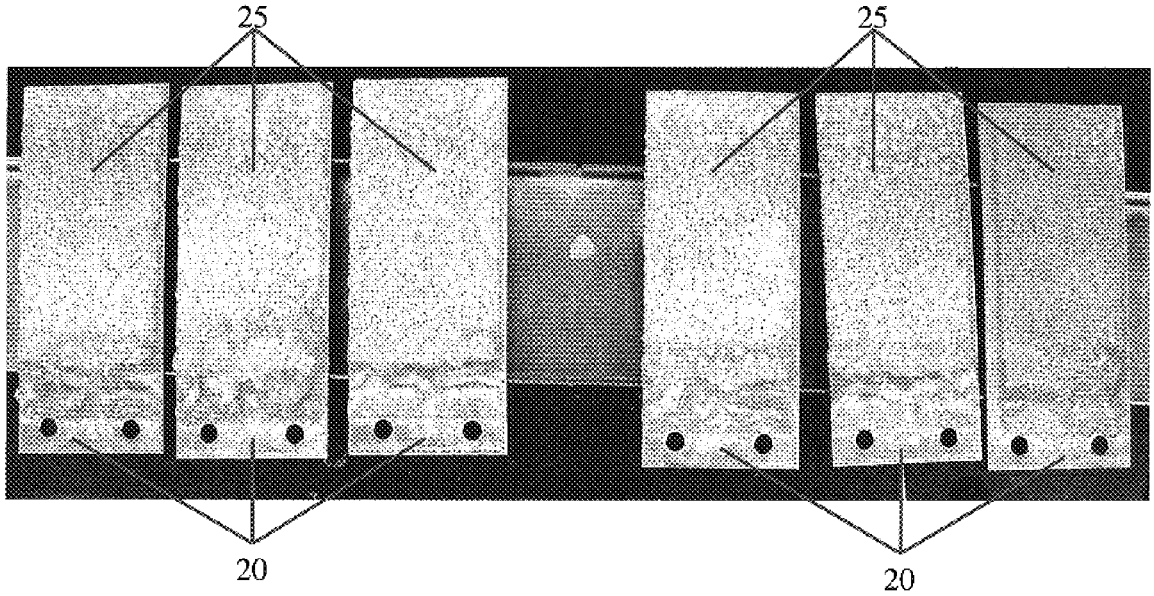
FIG. 2 shows the same series of panels as in FIG. 1 after immersion in an alkaline wash only.
Figure 3:
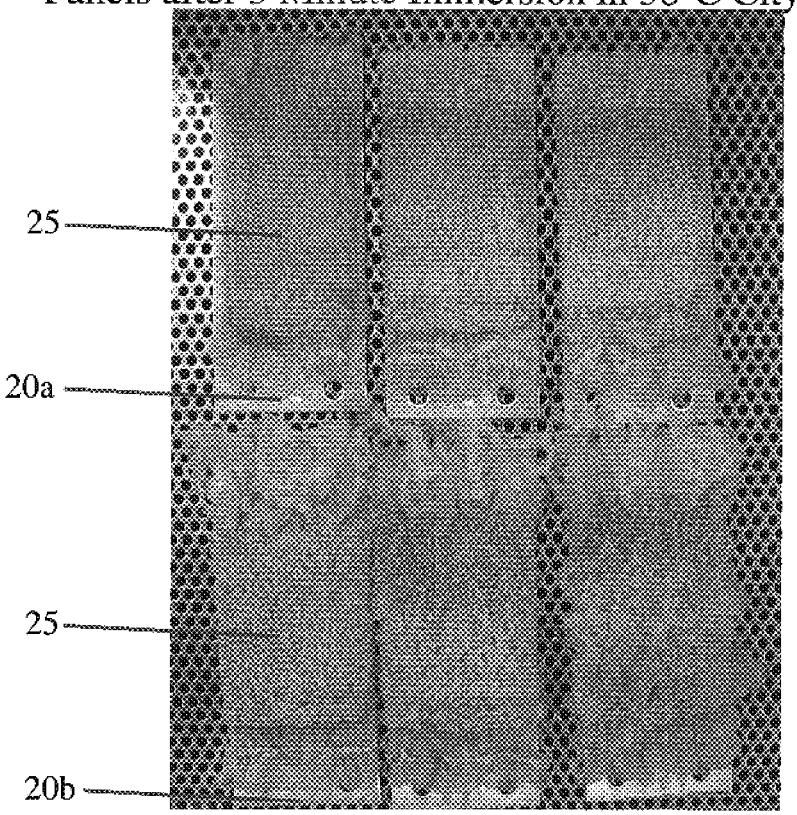
FIG. 3 illustrates HTST panels after immersion in an alkaline wash followed by dehydration and rehydration.

High temperature/short time (HTST) pasteurization panels 20 were exposed to recirculated whole milk for 3 hours at a temperature of 76° C. (about 169° F.) as shown in FIG. 1. The milk soil 25 is visible on the surface of the panels. The panels were then immersed for 10 minutes in an alkaline cleaning composition according to the present invention having a sodium hydroxide concentration of 1.5 wt-% and also having 0.6 wt-% of Exxelerate® 320, a chelating additive available from Ecolab, Inc. in St. Paul, Minn. FIG. 2 shows the HTST panels 20 after this step.

The panels were then dehydrated. Half of the panels for each example were oven dried for 10 minutes at 95° C. (panels 20*a*) and half were oven dried for 20 minutes at 95° C. (panels 20*b*).

The panels were then immersed in 38° C. city water for various amounts of time for rehydrating the soil. The treatment for each example is summarized in the following table.

TABLE 1

| | | | | | | | | |
|---|---|---|---|---|---|---|---|---|
| Alkaline wash (minutes) | 10 | 10 | 10 | 10 | 10 | 10 | 10 | 10 |
| Dehydration @ 95° C. (minutes) | 10 | 20 | 10 | 20 | 10 | 20 | 10 | 20 |
| Rehydration in 38° C. city water at a neutral pH (minutes) | 3 | 3 | 6 | 6 | 20 | 20 | 60 | 60 |

The results of each treatment are shown in FIGS. 3–6. The panels 20*a* and 20*b* shown in FIG. 3 were dried for 10 minutes and 20 minutes respectively, and were then reimmersed in city water for 3 minutes at a temperature of 38° C. Increasing the dehydration time to 20 minutes showed improvement in the loosening of the soil from the HTST panel as can be seen from FIG. 3.

Figure 4:
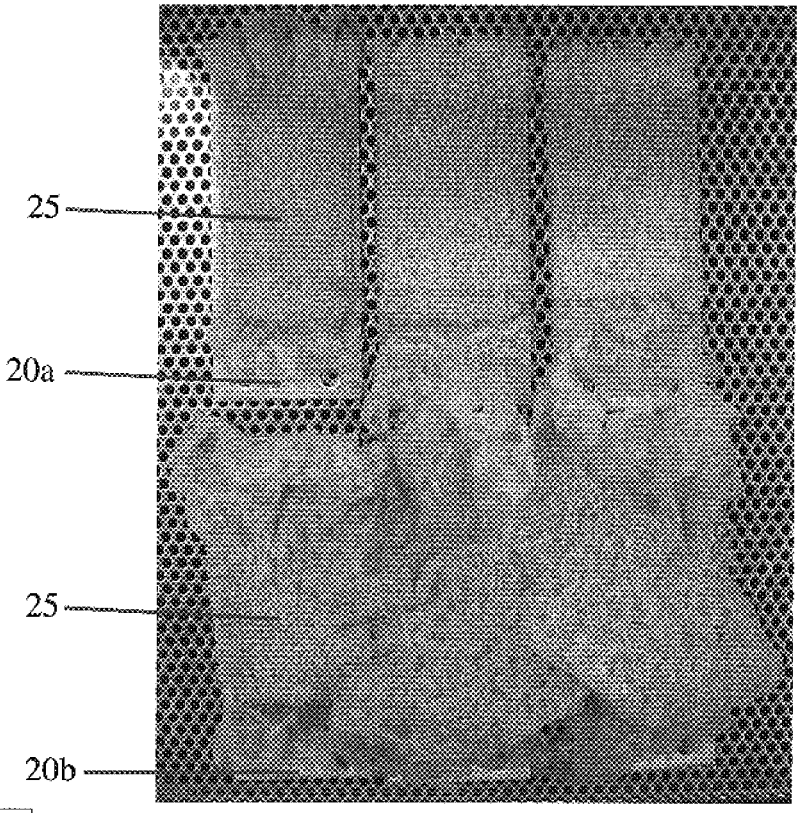
FIG. 4 illustrates HTST panels after immersion in an alkaline wash followed by dehydration and rehydration for a longer period of time than those shown in FIG. 3.

FIG. 4 illustrates the results of the treatment of identical treatment of the panels except that the step of rehydration in city water at 38° C. has been increased to 6 minutes. As can be seen from FIG. 4, the soil has loosened more from the panels by increasing the rehydration step from 3 minutes in combination with a 20 minute drying time. The milk soil 25 is now lifted significantly from HTST panels 20*b*.

Figure 5:
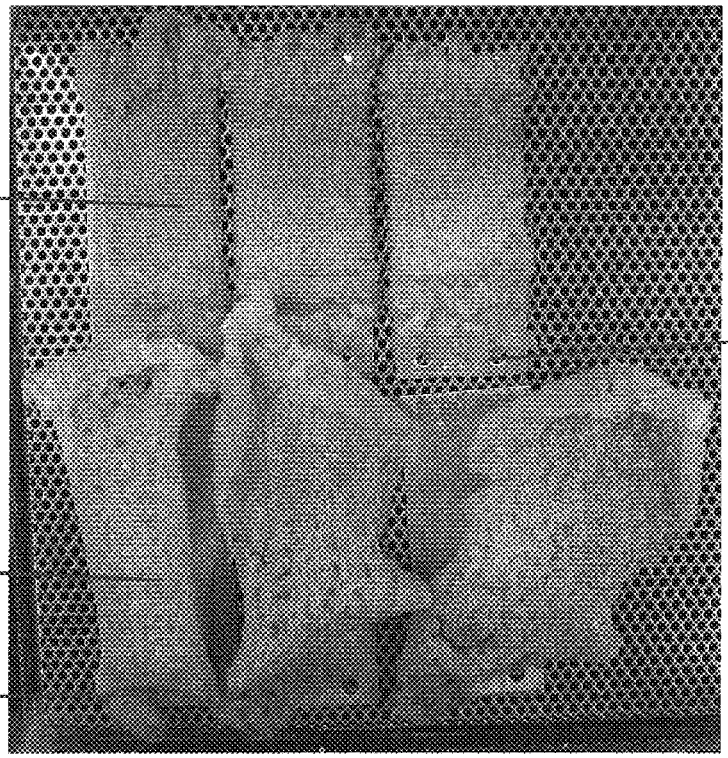
FIG. 5 illustrates HTST panels after immersion in an alkaline wash followed by dehydration and rehydration for a longer period of time than those shown in FIGS. 3–4.

The rehydration was then increased to 20 minutes. These results are shown in FIG. 5. In this case, with a 20 minute dehydration step, the milk soil 25 is almost completely removed from the HTST panels 20*b*.

Figure 6:
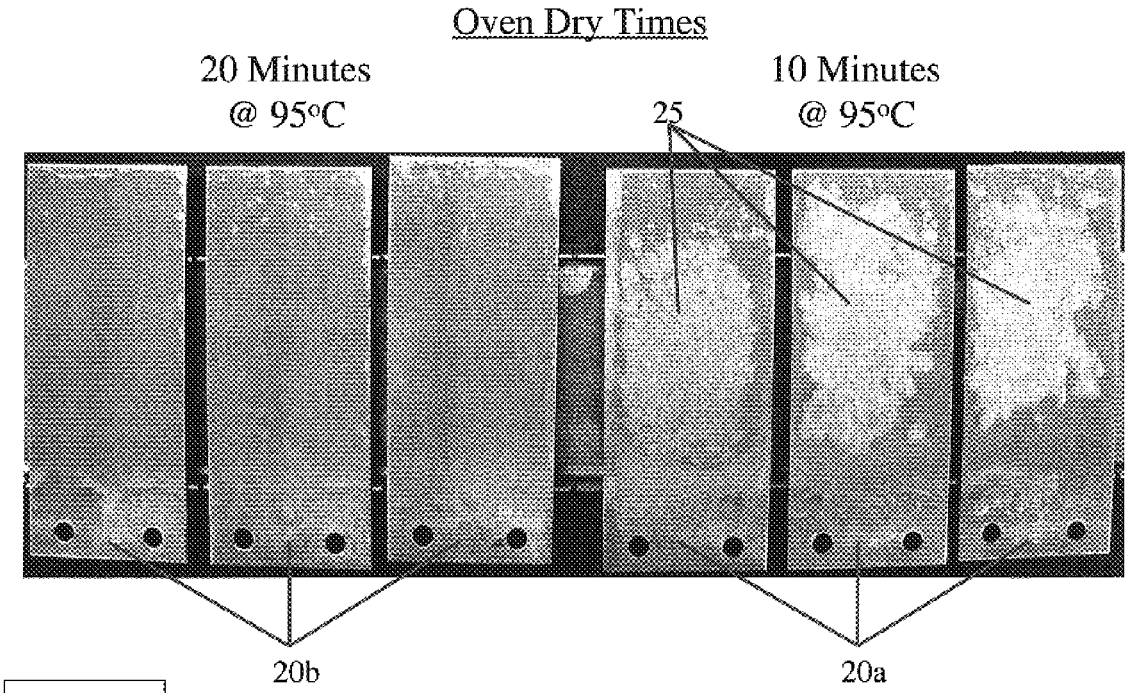
FIG. 6 illustrates HTST panels with immersion in an alkaline wash followed by dehydration and rehydration for a longer period of time than those shown in FIGS. 3–5.

FIG. 6 illustrates the results of the treatment when rehydration in city water at 38° C. is increased to 1 hour. With a 20 minute drying or dehydration step, the soil is completely removed from the HTST panels 20*b* while some milk soil 25 still remains on panels 20*a* after only 10 minutes of drying.

Example 2

Figure 7:
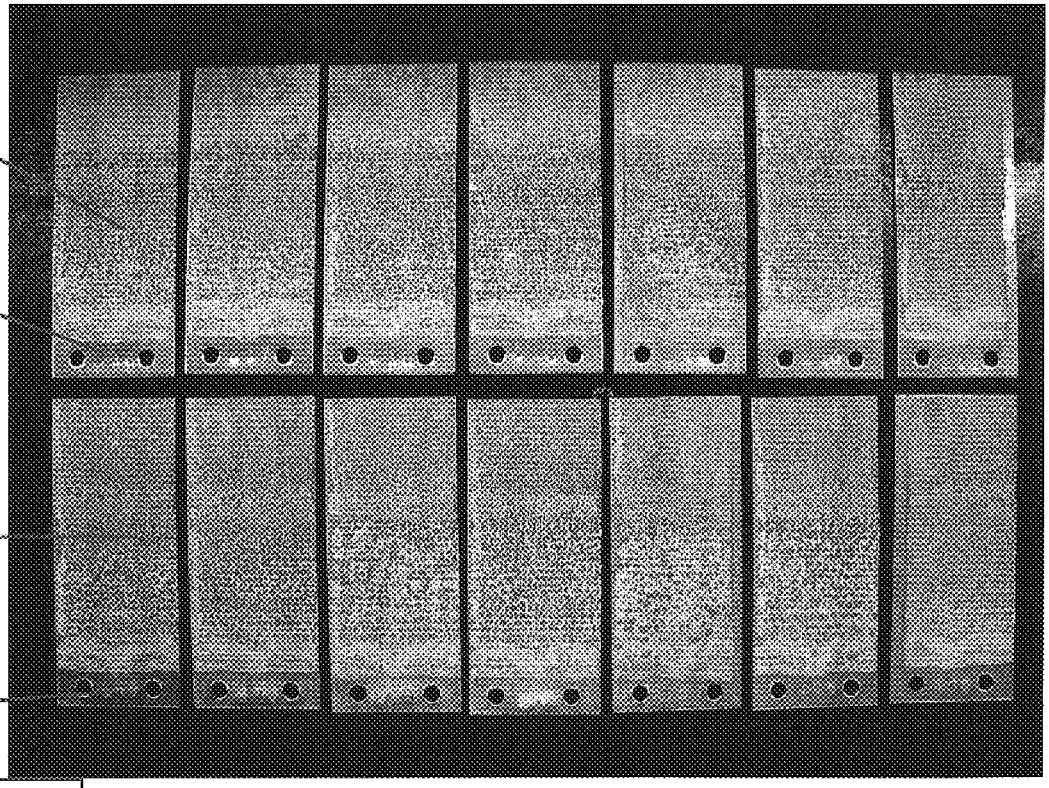
FIG. 7 shows HTST milk soiled panels.
Figure 8:
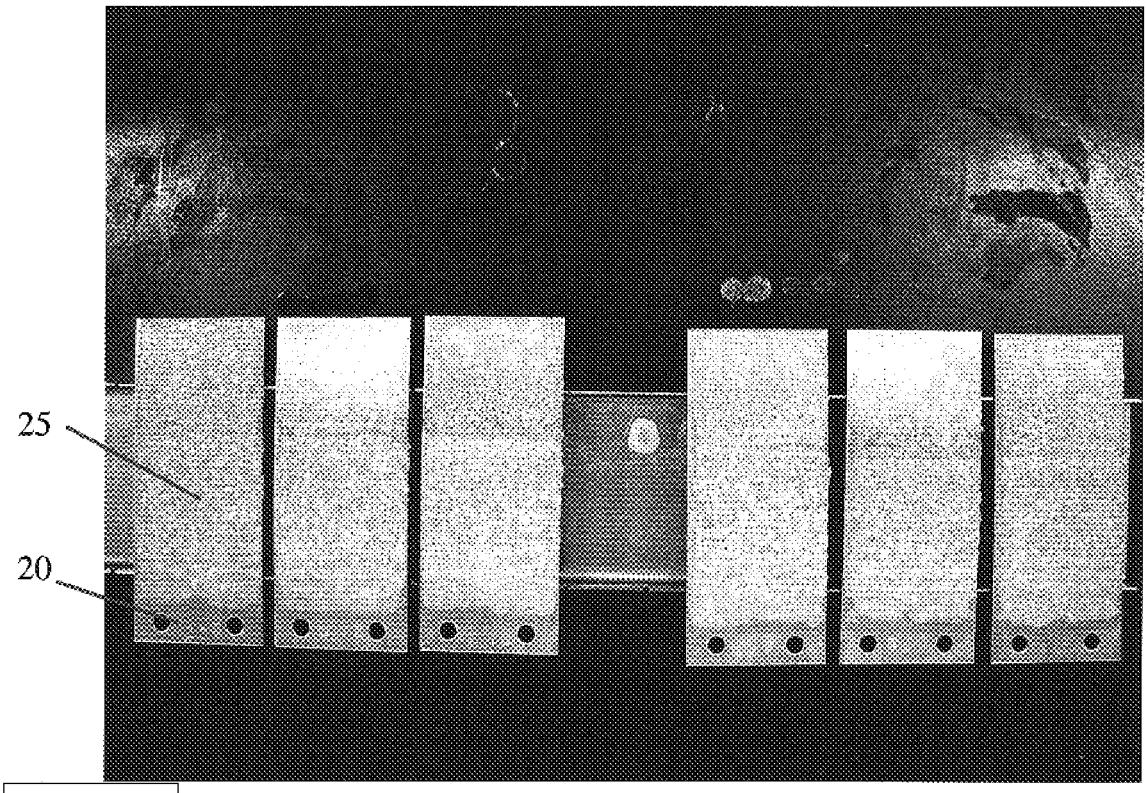
FIG. 8 illustrates HTST milk soiled panels after immersion in an alkaline composition only.

This example was used to show the difference exhibited in the HTST soiled panels after treatment employing two different rinses, one being alkaline and one being neutral. HTST panels were exposed to recirculated whole milk at a temperature of 78° C. for 3 hours and 45 minutes. FIG. 7 shows the HTST panels 20 with the milk soil 25 on the surface of each panel 20. The panels were then immersed for 15 minutes in an alkaline composition according to the present invention having 1.5 wt-% sodium hydroxide and 0.6 wt-% of Stabilon® ACP, a chelating additive available from Ecolab, Inc. in St. Paul, Minn. FIG. 8 shows some of the HTST panels 20 after this step.

Figure 9:
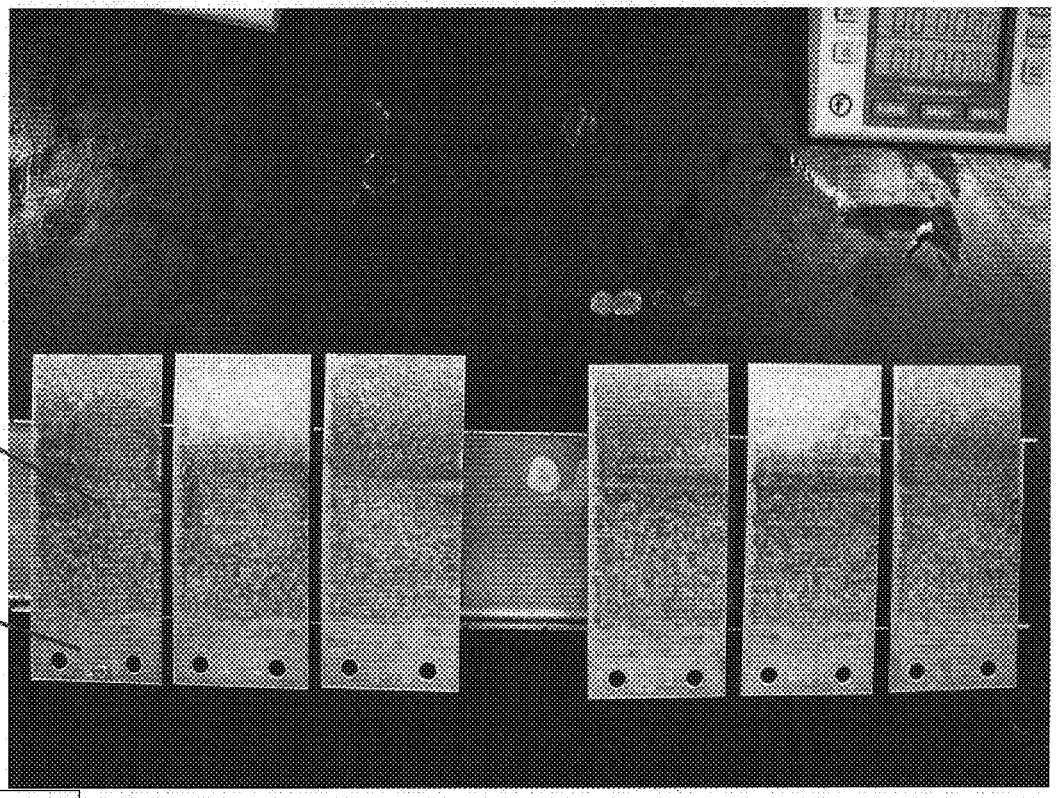
FIG. 9 illustrates HTST milk soiled panels after immersion in the same alkaline composition as shown in FIG. 8 and then further dried.
Figure 10:
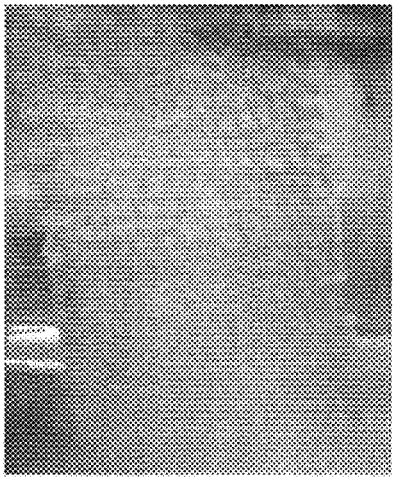
FIG. 10 illustrates an HTST milk soiled panel after immersion in an alkaline wash followed by dehydration and rehydration at an alkaline pH.
Figure 11:
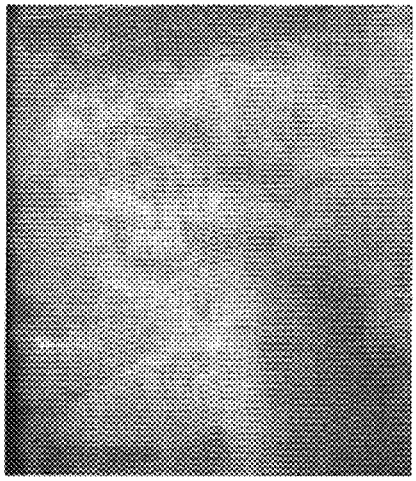
FIG. 11 illustrates an HTST milk soiled panel after immersion in an alkaline wash followed by dehydration and rehydration at a neutral pH.

Some of the panels were immersed in the alkaline composition as described above, and then further dried for 15 minutes at 95° C. These panels are shown in FIG. 9. These panels were then re-immersed in two different aqueous rinse compositions for 12 minutes. One HTST panel which was treated with an alkaline rinse composition is shown in FIG. 10 and one HTST panel treated with a neutral rinse composition by immersion in water only is shown in FIG. 11. The alkaline rinse composition included 0.5 wt-% sodium hydroxide and about 0.015 wt-% sodium gluconate. Both of the panels which were dried and rinsed exhibited better soil removal (see FIGS. 10 and 11) than those which were just treated with the alkaline wash solution and/or dried (see FIGS. 8 and 9). Further, the neutral rinse solution exhibited more release of the soil from the surface of the HTST panel as shown in FIG. 11.

Figure 12:
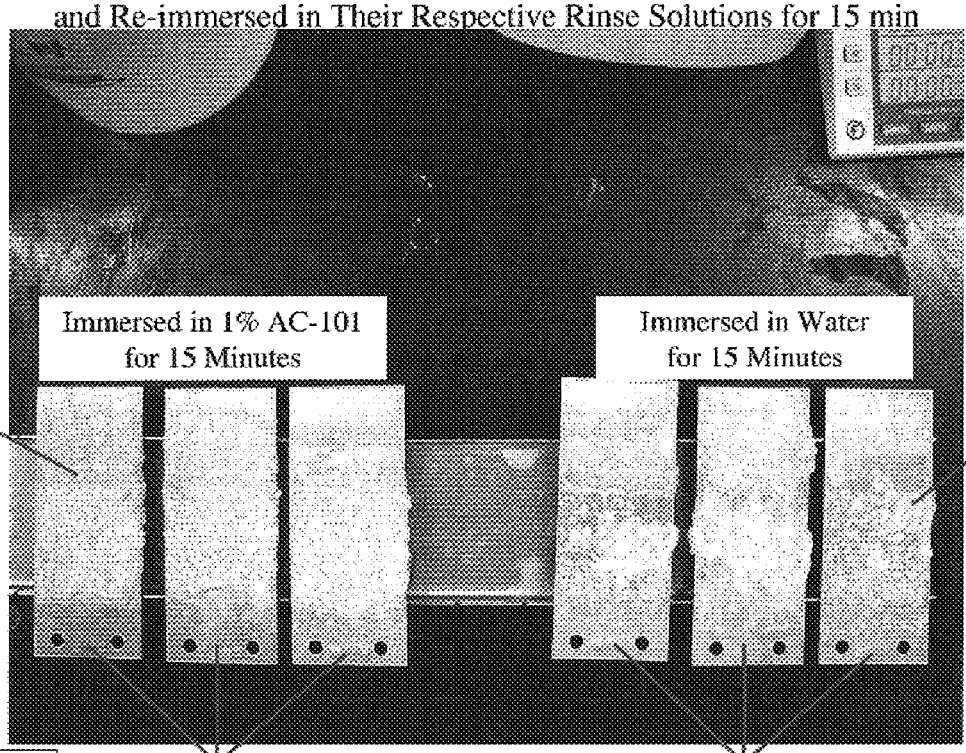
FIG. 12 illustrates HTST milk soiled panels after treatment according to the present invention with immersion in an alkaline wash followed by dehydration and rehydration.

The immersion in the alkaline rinse and the neutral rinse was then increased to 15 minutes. HTST panels 20*d* were immersed in the alkaline rinse for 15 minutes and HTST panels 20*c* were immersed in water at a neutral pH for 15 minutes. FIG. 12 shows the results of this treatment. As can be seen from FIG. 12, increasing the rehydration step by only 3 minutes improved the removal of the soil from the surface of the HTST soiled panels. The neutral rinse or rehydration step exhibited better soil removal than the alkaline rinse or rehydration.

The treatment steps are summarized in the following table 2.

TABLE 2

| | | | | |
|---|---|---|---|---|
| Alkaline wash | 15 minutes | 15 minutes | 15 minutes | 15 minutes |
| Drying @ 95° C. | 15 minutes | 15 minutes | 15 minutes | 15 minutes |
| Rinse w/ 0.5% NaOH | 12 minutes | — | 15 minutes | — |
| Rinse w/ water | — | 12 minutes | — | 15 minutes |

Example 3

Figure 13:
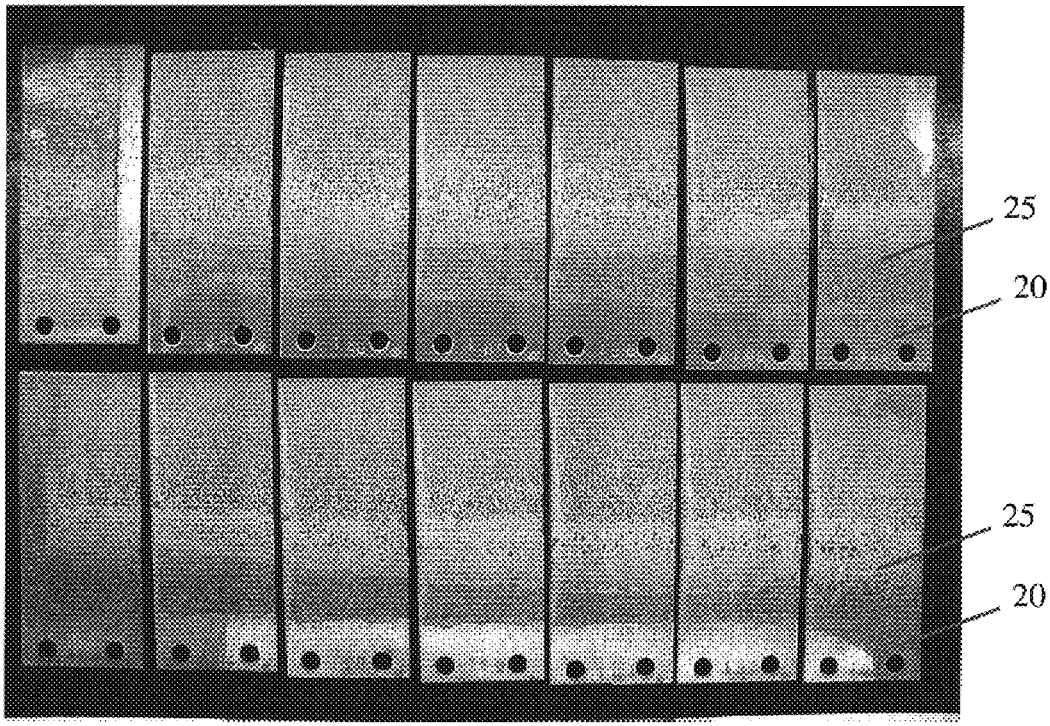
FIG. 13 shows HTST milk soiled panels after recirculation with whole milk.

Twelve HTST panels were exposed to recirculated whole milk for 3 hours at 77° C. The panels are shown in FIG. 13.

In this example, three different alkaline washes were employed. The first alkaline wash included no surfactants and no chelating agents, while alkaline wash 2 employed a blend of surfactants and a chelating additive, and alkaline wash 3 employed a different combination of surfactants than those of alkaline wash 2 with the same chelating additive as in alkaline wash 2. These three different alkaline washes are shown below.

Additionally, some of the panels which were washed with the first alkaline wash were treated differently in subsequent steps by varying the amount of time the HTST panels were rinsed or washed. The first two panels shown in the top left hand corner of FIG. 14, were washed for 20 minutes, rinsed for 10 minutes at 100° F. (about 38° C.) and dried overnight.

Figure 14:
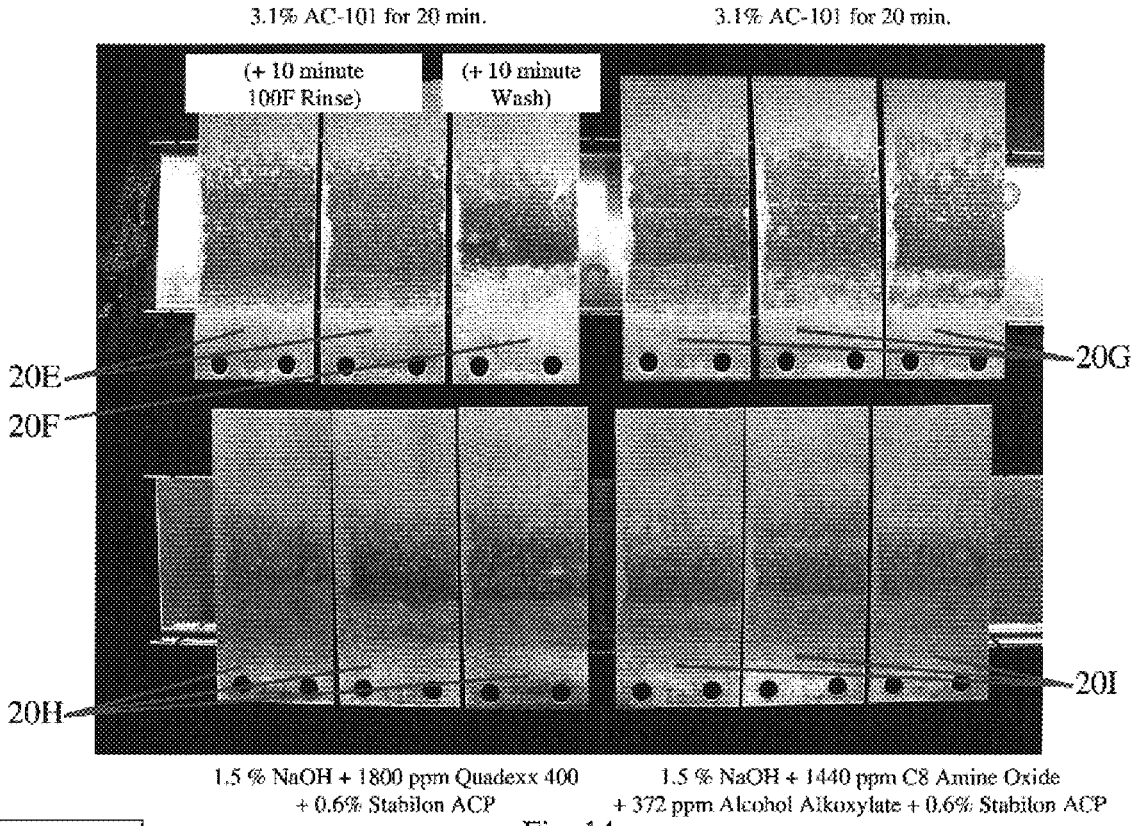
FIG. 14 illustrates HTST milk soiled panels after immersion of panels in several different alkaline washes.

Panel 20F, middle of FIG. 14, was washed for 30 minutes, briefly rinsed, and then dried overnight. Panels 20G, top right hand corner, were washed for 20 minutes, rinsed briefly, and dried overnight. Panel 20F, washed for an additional 10 minutes, exhibited slightly less soil remaining on the panel after this step.

The three panels 20H, shown in the bottom left hand corner of FIG. 14, were washed in alkaline wash 2, rinsed briefly, and dried overnight.

The three panels 20I, shown in the bottom right hand corner of FIG. 14, were washed with alkaline wash 3, rinsed briefly, and then dried overnight.

Figure 15:
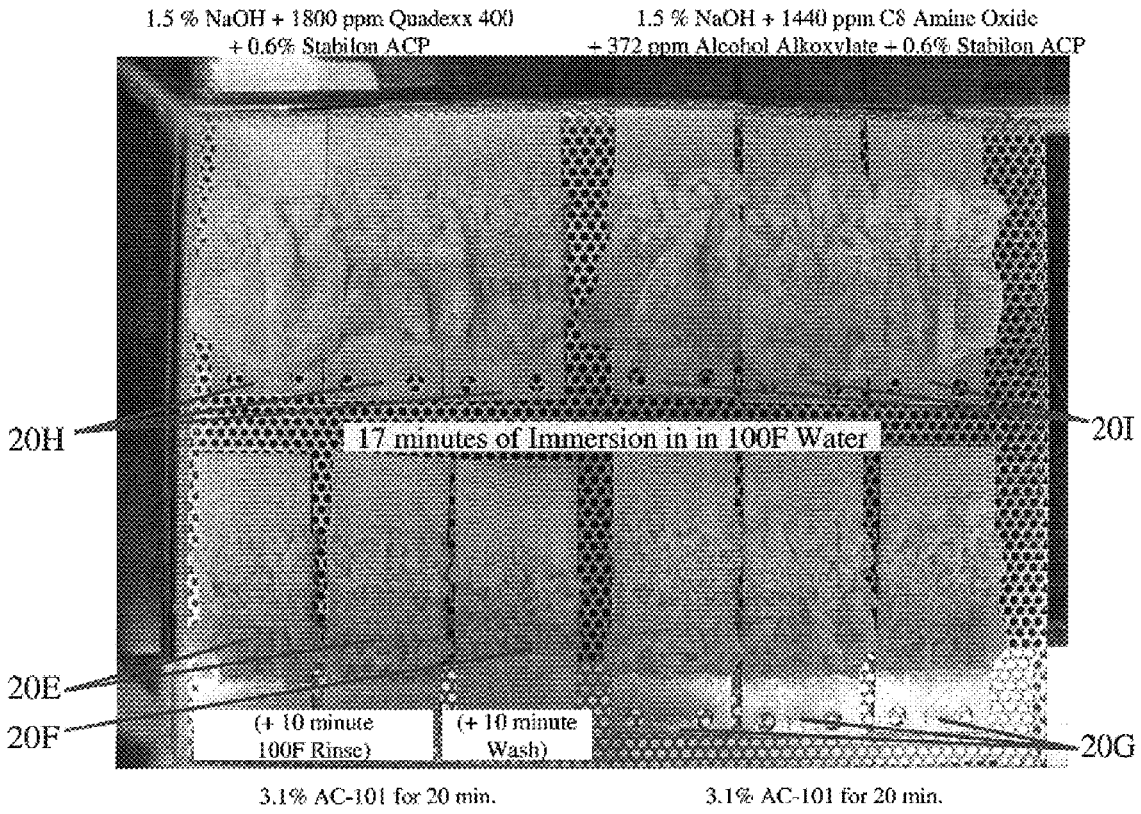
FIG. 15 illustrates HTST milk soiled panels after immersion in several different alkaline washes with overnight room temperature dehydration followed by rehydration.
Figure 16:
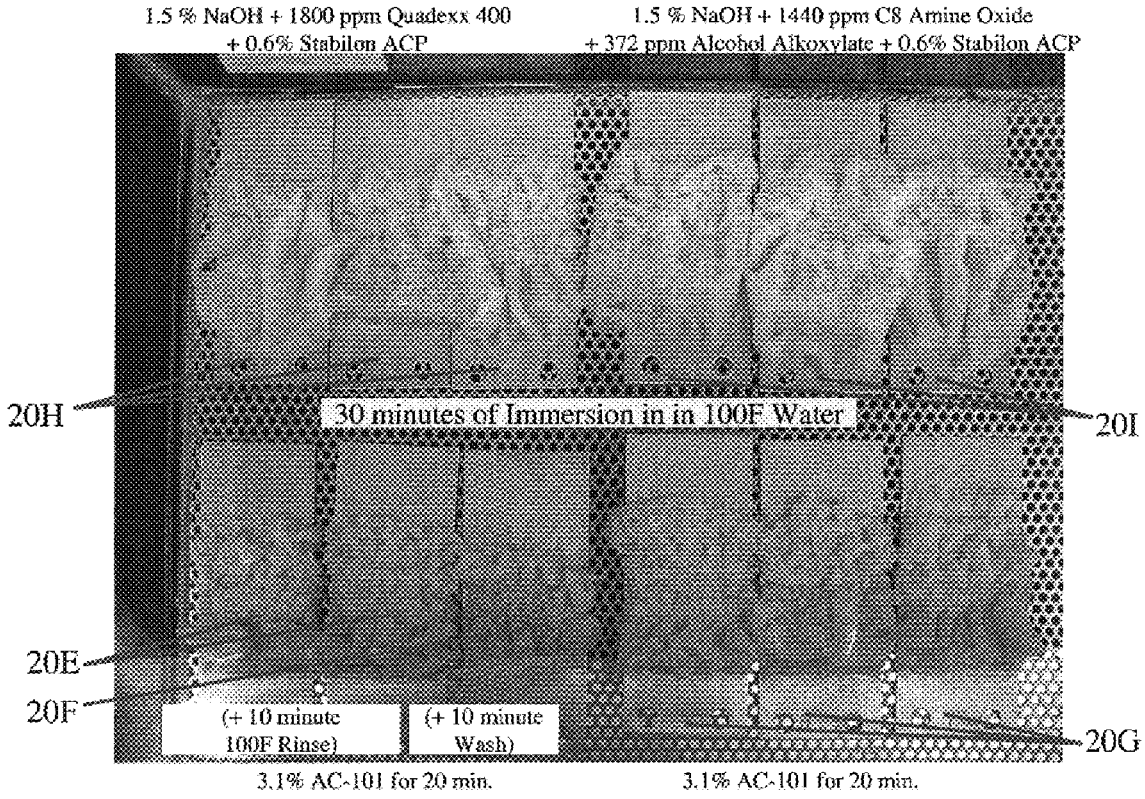
FIG. 16 illustrates HTST milk soiled panels after immersion in several different alkaline washes with overnight room temperature dehydration followed by rehydration over a longer period of time than those in FIG. 15.

The panels were then all rinsed or rehydrated for 17 minutes in 100° F. (about 38° C.) water. The results are shown in FIG. 15. The three panels 20I, shown in the upper right hand corner of FIG. 15, washed with alkaline wash 3, exhibited the most soil loosening from the surface of the panels.

After 30 minutes of rinsing, all of the panels showed slightly more soil loosening than rinsing for 17 minutes with alkaline wash 3 still exhibiting the most as evidenced by panels 20I shown in the upper right hand corner.

TABLE 3

| Example 1/ Alkaline wash 1 | Example 2/Alkaline wash 2 | Example 3/Alkaline Wash 3 |
|---|---|---|
| 1.5 wt % sodium hydroxide | 1.5 wt % sodium hydroxide | 1.5 wt % sodium hydroxide |
| 0.05 wt % sodium gluconate | $3.4 \times 10^{-4}$ wt % D-glucoside, hexyl | 0.0014 wt % octyl dimethylamine oxide |
| | $1.7 \times 10^{-4}$ wt % 1-octanamine, N,N-dimethyl-, N-oxide | |
| | $3.7 \times 10^{-4}$ wt % oxylated linear alcohol carboxylic acid adduct | $3.7 \times 10^{-4}$ wt % monofunctional linear alcohol alkoxylate |
| | $7.6 \times 10^{-5}$ wt % poly(oxy-1,2-ethanediyl), α-(2-ethylhexyl)-ω hydroxy | |
| | Stabilon ® ACP chelating additive | Stabilon ® ACP chelating additive |

For alkaline wash 2, the first four ingredients form a surfactant blend, while the last four ingredients form a chelating blend. For alkaline wash 3, the first two ingredients are surfactants, while the last four ingredients for a chelating blend.

Example 13

Figure 17:
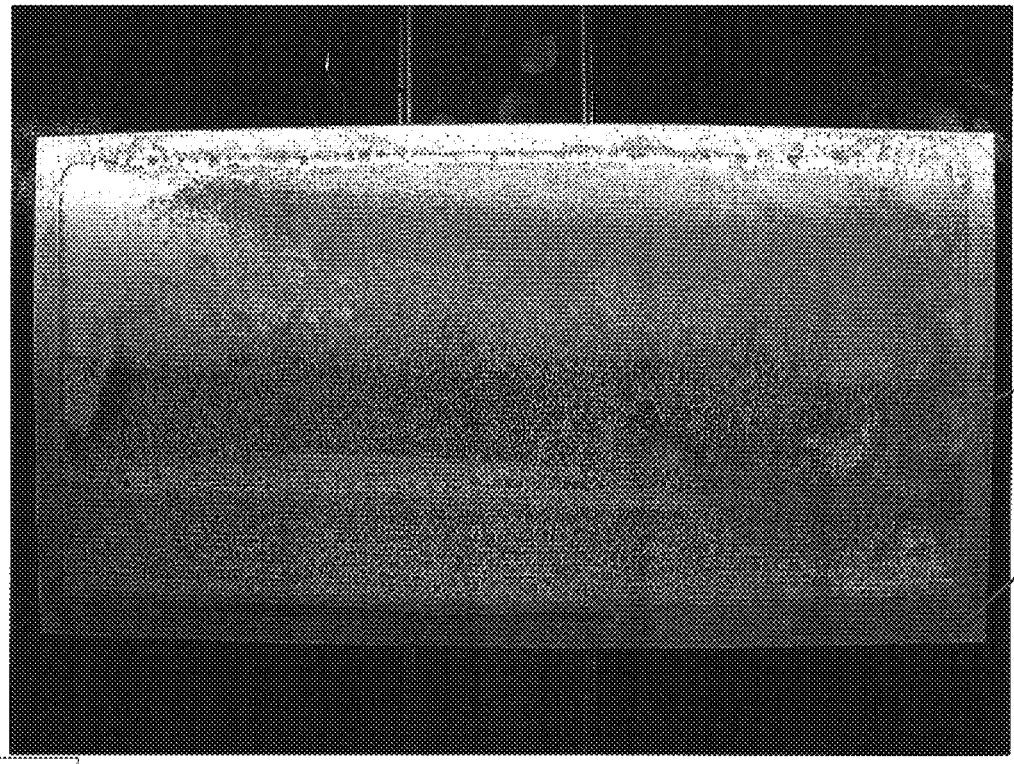
FIG. 17 shows an HTST after recirculation with whole milk.
Figure 18:
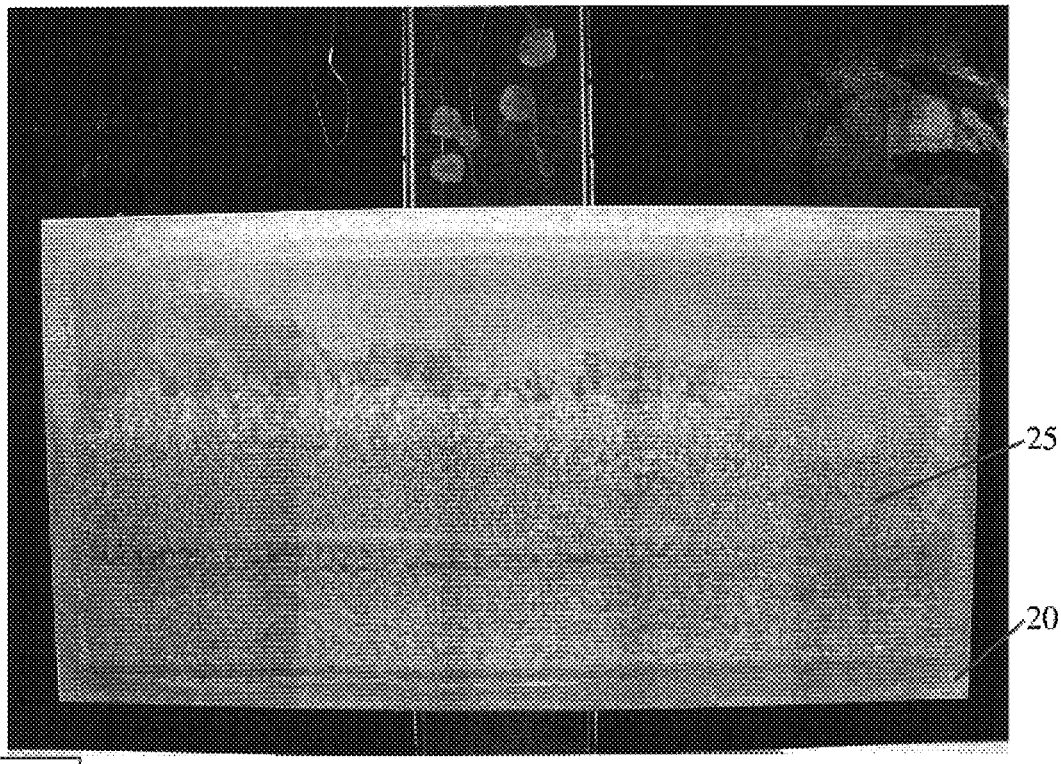
FIG. 18 shows the HTST soiled panel of FIG. 17 after immersion in an alkaline wash only.

An HTST panel was exposed to recirculated whole milk for 3 hours at 80° C. The panel is shown in FIG. 17. The HTST panel was then immersed in an alkaline wash composition at a temperature of 150° F. (about 65.5° C.) for 20 minutes as shown in FIG. 18. The milk soil 25 is visible on the surface of the HTST panel 20. The alkaline wash composition included 1.5 wt-% sodium hydroxide and about 0.05 wt-% sodium gluconate in the wash composition. The alkaline wash composition also included 0.6 wt-% Stabilon® ACP, a chelating additive available from Ecolab, Inc. in St. Paul, Minn.

Figure 19:
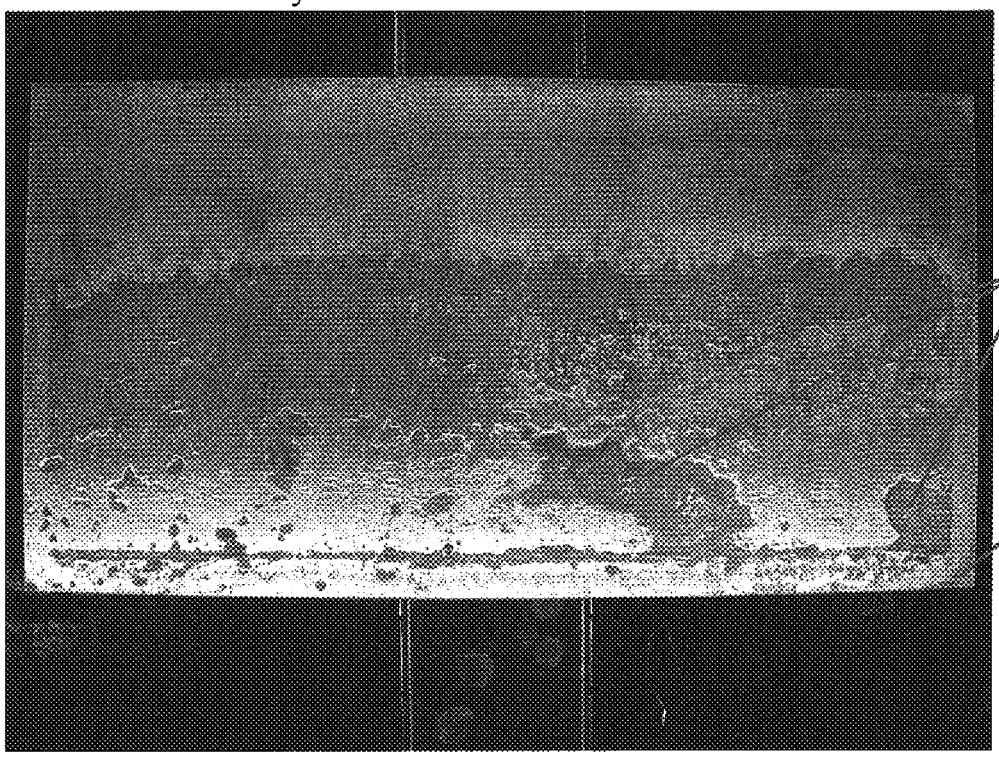
FIG. 19 shows the HTST soiled panel after immersion in an alkaline wash followed by dehydration and rehydration in water.

The HTST panel was then dried for 30 minutes in a laboratory heat exchanger unit with steam followed by immersion in 100° F. (about 38° C.) water for 20 minutes. The panel 25 is shown after this treatment in FIG. 19. Very little milk soil 25 remains on the panel.

The above disclosure is intended for illustrative purposes only and is not exhaustive. The embodiments described therein will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A method for the removal of soil from an article having a soiled surface,the method comprising the steps of:

a) immersing said article in an alkaline composition having a concentration of at least one source of alkalinity of about 0.25% or higher;

b) dehydrating said soil by heating, by blowing air over the soiled surface or both at a temperature which is higher than ambient wherein the moisture content of the soil is reduced by about 10% to 100% of original moisture contact; and c) rehydrating said soil with an aqueous composition at a pH which is about neutral.

2. The method of claim 1 wherein said source of alkalinity is an alkali metal hydroxide, an alkaline earth metal hydroxide, an alkylamine, an ethanolamine, an alkali metal carbonate or bicarbonate, a silicate, or a mixture thereof.

3. The method of claim 1 wherein said source of alkalinity is sodium hydroxide, potassium hydroxide, magnesium hydroxide, calcium hydroxide, ammonium hydroxide, or a mixture thereof.

4. The method of claim 1 wherein step c) results in swelling of the soil.

5. The method of claim 1 wherein said alkaline composition further comprises at least one surfactant or chelating agent.

6. The method of claim 5 wherein said surfactant is selected from the group consisting of nonionic, anionic, cationic, amphoteric, zwitterionic surfactants and mixtures thereof.

7. The method of claim 5 wherein said at least one surfactant is selected from the group consisting of amines, amine oxides, linear alcohol alkoxylates, capped alcohol alkoxylates, phosphate esters, phosphates, phosphonates, sulfates, sulfonates, quaternary ammonium compounds, alkylpolyglycosides, alkanolamides, copolymers of ethylene oxide and propylene oxide, betaines, modified carboxylates, sulfosuccinates, and mixtures thereof.

8. The method of claim 5 wherein said at least one chelating agent is selected from the group consisting of an aminocarboxylic acid, a condensed phosphate, a phosphonate, a polyacrylate, an iminodiacetic acid, and mixtures thereof.

9. The method of claim 5 wherein said at least one chelating agent is ethylenediaminetretracetic acid (EDTA), n-hydroxyethyliminodiacetic acid, nitrilotriacetic acid (NTA), N-hydroxyethyl-ethylenediaminetriacetic acid (HEDTA), diethylenetriaminepentaacetic acid (DTPA), sodium and potassium orthophosphate, sodium and potassium pyrophosphate, sodium tripolyphosphate, sodium hexametaphosphate, aminotris(methylene phosphonic acid), hydroxyethylidene diphosphonic acid, ethylenediaminetetrae(methylene phosphonic acid), diethylenetriaminepente(methylene phosphonic acid), polyacrylic acid, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and mixtures thereof.

10. The method of claim 1 wherein said alkaline composition further comprises at member selected from the group consisting of solvents, oxidizing agents, reducing agents, water hardness controlling agents, urea, bleaching agents, enzymes, and mixtures thereof.

11. The method of claim 10 wherein said alkaline composition further comprises at least one solvent selected from the group consisting of glycol ethers, alcohols, soy methyl ester, acetates, cyclic acids, and mixtures thereof.

12. The method of claim 1 wherein said drying step is at a temperature between about 15° C. to about 200° C.

13. The method of claim 1 wherein said alkaline composition has a pH of about 10 or higher.

14. The method of claim 1 wherein said drying temperature is about 70° C. to about 100° C. for about 10 minutes to about 20 minutes.

15. The method of claim 1 wherein said rehydrating step is at a temperature of about 20° C. to about 90° C.

16. The method of claim 1 wherein said aqueous composition for rehydrating comprises at least one member selected from the group consisting of surfactants, solvents, oxidizing agents, reducing agents, water hardness controlling agents, urea, bleaching agents, enzymes, and mixtures thereof.

17. The method of claim 1 wherein said soil is proteinaceous.

18. The method of claim 1 wherein said soil is milk soil.

19. The method of claim 1 wherein said article is food or beverage processing equipment.

20. The method of claim 1 wherein said article is processing equipment for dairy products.

21. The method of claim 1 wherein said article is a cheese vat, fast-food milkshake machine, pasteurizer, whey evaporator, permeate evaporator, ultra-high temperature dairy processing equipment, or a mixing vessel used to make dairy-based products that require heating.

* * * * *